US006390008B1

(12) United States Patent
Beato et al.

(10) Patent No.: US 6,390,008 B1
(45) Date of Patent: May 21, 2002

(54) TENDER FOR PRODUCTION PLATFORMS

(76) Inventors: Christopher Louis Beato, 9411 N. Fitzgerald Way, Missouri City, TX (US) 77459; Yi Suang David Tein, 502 Woodland La., Houston, TX (US) 77079

( * ) Notice: Subject to any disclaimer, the term of this patent is extended or adjusted under 35 U.S.C. 154(b) by 0 days.

(21) Appl. No.: 09/847,018

(22) Filed: May 1, 2001

Related U.S. Application Data

(60) Provisional application No. 60/238,177, filed on Oct. 5, 2000.

(51) Int. Cl.[7] ..... B63B 21/00

(52) U.S. Cl. ..... 114/230.2; 114/293; 114/264

(58) Field of Search ..... 114/230.1, 230.2, 114/293, 294, 264; 441/3–5; 405/195.1, 196, 209

(56) References Cited

U.S. PATENT DOCUMENTS 3,922,992 A * 12/1975 Wilbourn ..... 114/230.1
4,065,934 A 1/1978 Dysarz ..... 61/87
4,156,577 A 5/1979 McMakin ..... 405/196
4,446,807 A * 5/1984 Johnson et al. ..... 114/265
5,730,425 A * 3/1998 Brooks ..... 114/293
5,979,353 A * 11/1999 Borseth ..... 114/293

* cited by examiner

*Primary Examiner*—Stephen Avila
(74) *Attorney, Agent, or Firm*—Wendy Buskop

(57) ABSTRACT

A mooring and tender system comprising: a deck; a shape that results in a combined environmental load of less than 1000 kips in a 100-year extreme weather condition; a plurality of supports connected to the deck; a plurality of pontoons connecting to the supports, at least two hawsers for connecting the tender to a production platform, each having adequate elasticity to accommodate the wave frequency between the production platform and the tender, and adequate stiffness to synchronize the mean and low frequency movement between the production platform and the tender under an environmental load produced during a storm having a designation of up to a 10-year storm in the tendering position, connecting means securing each hawser; a hawser guidance system; an at least 8-point mooring system with each mooring lines consisting of: a first length of steel wire rope; a length of polymer rope secured to the first length of steel wire rope; a second length of steel wire rope secured to the polymer rope; and means for creating global equilibrium between the production platform's mooring means and the at least 8 point mooring system of the tender.

53 Claims, 5 Drawing Sheets

TENDER FOR PRODUCTION PLATFORMS

This application claims the benefit of priority of co-pending provisional application Serial No. 60/238,177, filed in the U.S. Patent and Trademark Office on Oct. 5, 2000.

BACKGROUND OF THE INVENTION

Field of the Invention

This invention relates to a semisubmersible tender adapted for facilitating servicing of off shore oil and natural gas production platforms, subsea wells, and other subsea infrastructure in water depths up to 10,000 feet.

The present invention specifically relates to a semisubmersible tender which can be secured to different types of production platforms, such as a tension leg platform (TLP), a deep draft cassion vessel (SPAR), a fixed platform, a compliant tower, a semisubmersible production vessel, or a floating vessel.

BACKGROUND OF THE INVENTION

It is very expensive to provide a production platform with adequate space for all the drilling and completion equipment needed to safely drill and complete a well and store drilling and completion equipment and materials in an environmentally conscientious manner, including drilling and completion risers, casings, tubings and drilling and completion fluids. Tenders have often been called into service to provide the required space needed on a rig and/or platform during the initial drilling and completion phase of an oil lease. Problems have traditionally existed in that most tenders cannot be kept alongside a platform in a constant spaced relationship during extreme weather without colliding with the platform. Specifically, tenders have not been able to remain in a connected capacity and avoid the risk of collision, enabling a high operational weather window to the tender and rig, and still endure the environmental load of up to a 10 year storm. See U.S. Pat. Nos. 4,065,934, and 4,156,577, which are hereby incorporated by reference on current tenders for platforms. Most tenders have had to be completely towed away to a safe location in the case of a tropical storm or extreme weather, which causes considerable expense to the drilling contractor and/or customer.

Until the existence of this invention described herein, it has been generally believed to be impossible to safely moor a tender to a floating production platform in water depths exceeding several hundred feet for long periods of time, exceeding one year or any time during hurricane season.

The present invention has been created to provide up to 25,000 square feet of additional deck space and over 8000 bbls of liquid storage capacity via a tender which is secured to the production platform by a unique technique which enables the tender to keep a constant distance from a production platform while synchronizing its low and mean movement frequencies, which enables the tender to follow the mooring watch pattern of the production platform, such as a figure eight pattern, or elliptical pattern, and to sustain without damage, the environmental load of wind, current and wave forces of a 100-year cyclonic storm (such as a hurricane) in the 100-year extreme weather standby position, and up to a 10-year storm in a tendering position.

The invention is related to a device, which has significant environmental and safety advantages over known systems and known tenders.

The invention includes the semisubmersible tender, a tender and mooring system which utilizes pre-set anchors, and a method of tendering to a deep-water production platform for assisting in the drilling and completion and recovery of oil and gas in weather that can be up to a 10-year storm and maintaining a standby position in weather up to a 100-year hurricane.

The present invention is directed to solving one or more of the above problems by providing a tender for facilitating installation operational support and removal of drilling and completion equipment on a production platform while compensating for platform motions in at least one plane.

SUMMARY OF THE INVENTION

The invention relates to a tender, and a mooring and tender system for securing a unique semisubmersible tender to a production platform. The semisubmersible tender has mooring means and a lightship displacement of less than 15,000 short tons and preferably between at least 8,000 and 15,000 short tons. The tender comprises a deck; a shape that results in a combined environmental load of less than 1000 kips in a 100-year extreme weather condition; a plurality of supports connected to the deck; a plurality of pontoons connecting the supports; at least two hawsers for connecting the tender to the production platform, each hawser having a length which is selected from the group: the length of the tender, the tendering distance, the length of the production platform, and combinations thereof; and wherein the hawsers have adequate elasticity to accommodate the wave frequency motions between the production platform and the tender, and adequate stiffness and tension to synchronize the mean and low frequency movement between the production platform and the tender under an environmental load produced during a storm having a designation of up to a 10-year storm in the tendering position.

This invention permits the tender to remain connected to the platform yet the hawsers remain slack during a storm designated as at least a 10-year storm for the tender in the tender standby position. The tender further has connecting means securing a first end of each hawser, and a hawser guidance system for each hawser to direct each hawser to the production platform.

The tender uses an at least 8-point mooring system for the tender which uses at least 8 anchors; at least 8 mooring lines, with each line consisting of: a first length of steel wire rope secured to each of the anchors; a length of polymer rope secured to each of the first length of steel wire rope; a second length of steel wire rope having a first and second end, and wherein the first end is secured to the length of polymer rope and the second end is secured to the tender. For the invention, each mooring line has adequate elasticity, stiffness and strength to accommodate load on the tender under an environmental load produced by an up to a 10-year storm in the tendering position, and further wherein the mooring lines have a strength to withstand the environmental load produced by up to a 100-year extreme weather condition when the tender is moved to a 100-year extreme weather condition standby position. The tender further has means for creating global equilibrium between the production platform's mooring means and the at least 8 point mooring system of the tender.

DETAILED DESCRIPTION OF THE PREFERRED EMBODIMENTS

Figure 1:
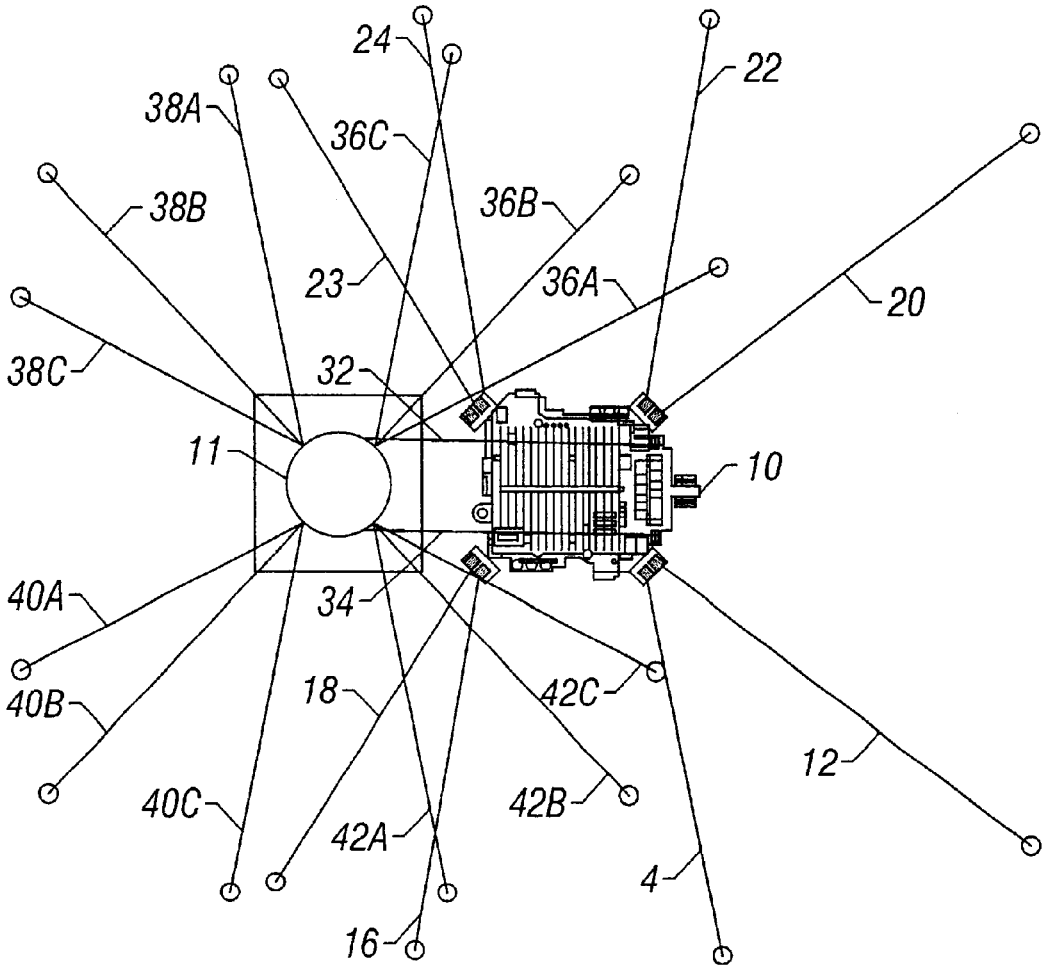
FIG. 1 is a top view of the moored tender secured to a production platform known as a SPAR.

The semisubmersible tender of the present invention can be used with a variety of production platforms, including both fixed production platforms and floating production platforms. Platforms that the tender can be tied to include deep draft cassion vessels (SPARs), tension leg platforms (TLPs), compliant towers, semisubmersible production vessels, or other floating ships or vessels.

The invention relates to a tender and mooring system which uses certain type of semisubmersible tender that can be attached to a production platform and successfully eliminates the risk of collision between the tender and the production platform during up to a 10-year winter storm, thereby significantly improving the health, safety and operating environment on an oil and natural gas production platform and drilling rig while enabling simultaneous drilling and production operations, to some extent, during that weather condition.

The present invention has significant environmental advantages over known systems of tendering. The present tender has significant safety advantages over known systems as well.

The invention has significant health, safety and environmental advantages, when used as compared to a platform rig and jack-up rig; inherent risks of those rigs are reduced on an event-by-event basis. Specifically:

a. The invention offers over 10 times the working deck space than either a platform rig or a jack up unit, virtually eliminating confined space logistical operations.

b. The operation of the tender requires only ⅕ to ⅓ of the equipment to be placed on the production platform compared to an API platform rig.

c. The invention is helpful because it does not require any engines or exhaust systems to be placed on the production platform, which therefore decreases the fire risk and blow-out risk associated with oil and gas well operations.

d. The modular design, combined with the use of a construction crane, mounted on the tender enables efficient and safe mobilization and support operations; significantly reducing the number of lifts required to initiate drilling and completion operations on the platform as compared to an API platform rig.

e. There are 90% fewer people required to be housed and work on the production platform itself, when the invention is used.

f. The unique invention's storage capacities enable much more efficient logistical planning and virtually eliminate nighttime logistical offloading or back loading which is where a significant percentage of accidents have historically occurred.

g. The invention's mooring system (i) enables a predictable operational weather window, matching or exceeding that of either a platform rig or a jack up rig; (ii) virtually eliminates the risk of collision damage during all operational events; (iii) enables the unit to quickly evacuate the immediate platform area in case of an emergency, and (iv) provide an ideal support unit to facilitate rescue or emergency response operations during an emergency.

h. Zero discharge of drilling and completion fluids, drill cuttings, spilled or uncontained leaks, and unprocessed water, including rainwater.

The invention also relates to a mooring and tender system for securing a tender to a production platform, comprising:

a. a semisubmersible tender for a production platform having mooring means and having a lightship displacement of less than 15,000 short tons, comprising:
   i. a deck;
   ii. a shape that results in a combined environmental load of less than 1000 kips in a 100-year extreme weather condition;
   iii. a plurality of supports with a rounded shape connected to the deck;
   iv. a plurality of pontoons connecting said supports, each pontoon being capable of transverse ballast transfer and longitudinal ballast transfer;
   v. at least two hawsers for connecting the tender to the production platform, each hawser having a length which is selected from the group: the length of the tender, the tendering distance, the length of the production platform, and combinations thereof; and wherein the hawsers have adequate elasticity to accommodate the wave frequency between the production platform and the tender, and adequate stiffness and tension to synchronize the mean and low frequency movement between the production platform and the tender under an environmental load produced during a storm having a designation of up to a 10-year storm in the tendering position, and wherein the hawsers remain slack during a storm designated as at least a 10-year storm for the tender in the tender standby position;
   vi. connecting means mounted on the tender and securing a first end of each hawser;
   vii. a hawser guidance system for each hawser to direct each the hawser to the production platform;

b. an at least 8-point mooring system for the tender comprising:
   ii. at least 8 anchors;
   iii. at least 8 mooring lines, each line consisting of: a first length of steel wire rope secured to each of the anchors; a length of rope secured to each of the first length of steel wire rope; a second length of steel wire rope having a first and second end, and wherein the first end is secured to the length of rope and the second end is secured to the tender; and wherein each the mooring line has adequate elasticity, stiffness and strength to accommodate load on the tender under an environmental load produced by an up to a 10-year storm in the tendering position, and further wherein the mooring lines have a strength to withstand the environmental load produced by up to a 100-year extreme weather condition when the tender is moved to a 100-year extreme weather condition standby position; and
   iv. means for creating global equilibrium between the production platform's mooring means and the at least 8 point mooring system of the tender.

Referring now to FIG. 1, the tender 10 can be moored with at least 8 mooring lines, 12, 14, 16, 18, 20, 22, 23 and 24. It is contemplated that the mooring system of the invention can be installed by first placing anchors in the sea floor, then attaching mooring lines to the anchors, placing a buoy on the line secured to the anchors, and then attaching the mooring line to the tender. A particular embodiment for a tender's mooring system in relation to a SPAR's mooring system is shown in FIG. 1.

For a SPAR 11, the tender 10 is secured to the SPAR 11, using at least two hawsers, 32 and 34. This production platform is also known as a deep draft cassion vessel. It should be noted that a SPAR is typically moored with 12 to 16 mooring lines in four cluster groups. FIG. 1 shows mooring lines 36*a*, 36*b*, 36*c*, 38*b*, 38*c*, 40*a*, 40*b*, 40*c*, 42*a*, 42*b* and 42*c*. This invention enables a SPAR to be used as a drilling and production platform without significantly increasing its size or cost, yet maintaining a high safety factor for the production crew on board the SPAR, while protecting the environment from harmful discharge.

Figure 2:
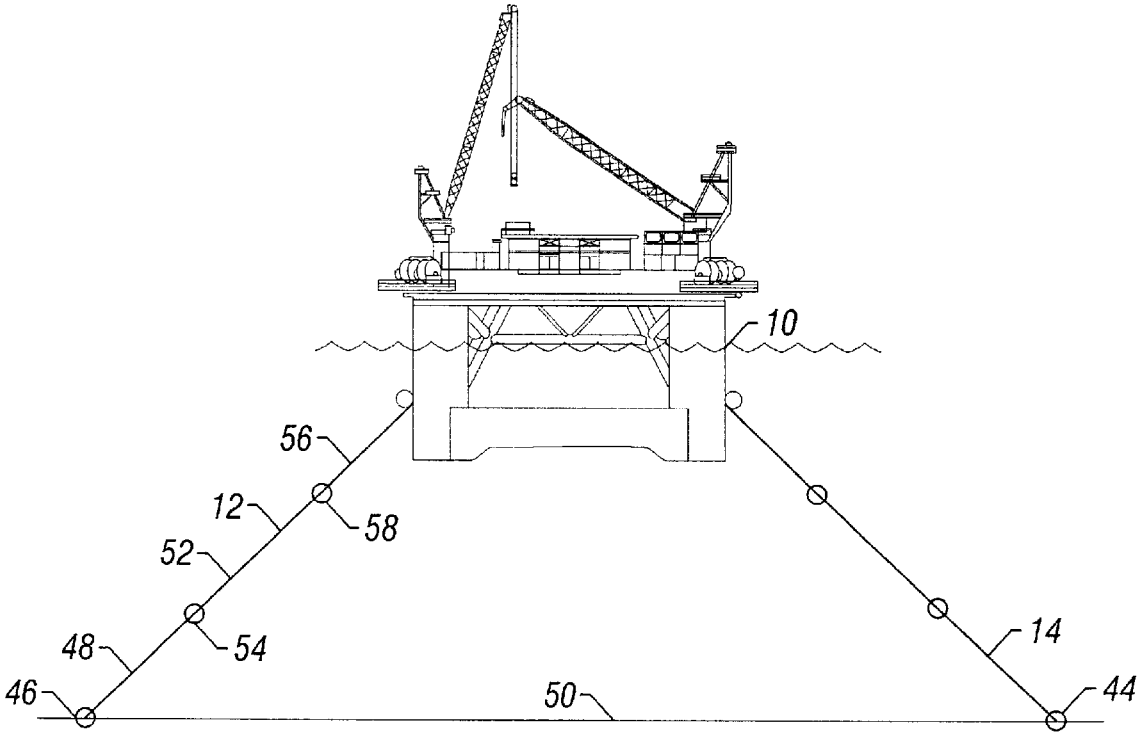
FIG. 2 shows mooring line orientations on a production platform for a moored tender.

FIG. 2 shows one example of the invention, where tender 10 is moored to the seafloor 50 through 6000 ft of water. Two mooring lines 12 and 14 are shown secured to anchors on the sea floor 50. A vertical loaded anchor 44 is used to moor the tender to the sea floor. An example of such an anchor is a plate anchor, as described in U.S. Pat. No. 6,122,847 and hereby incorporated by reference. Alternatively, a piled anchor which is suction installed can be used as the mooring anchor for the tender. The anchor 44 is secured to one end of mooring line 14. A second anchor 46 is shown secured to a second end of mooring line 12. On the other end, is secured to a first length of steel rope 48, which is termed "anchor wire rope."

In 6000 feet of water where a tender is moored to a SPAR, the length of the anchor wire rope 48 is typically 1500 feet and has a preferred outer diameter of 4½ inches. The breaking strength of anchor wire rope 48 is at least 2061 kips.

Anchor wire rope 48 is connected to a polymer rope 52, which is most preferably a polyester rope made by Marlow, UK, or Whitehill Manufacturing Corporation, U.S.A., or CSL (Cordvaia) of Saul Leopoldo, Brazil. The length of the polymer rope 52 for 6000-feet of water is preferably 5,500 feet using an outer diameter of 7.1 inches. The outer diameter of polymer rope 52 can vary between 4 and 10 inches and still remain usable in this invention. The breaking strength of the polymer rope 52 should be at least 2300 kips. A buoy 54, preferably having a net buoyancy of at least 40 kips and up to 100 kips, is secured to polymer rope 52 to keep mooring line 12 off the sea floor 50.

In an embodiment where the water is 1760 feet, it is contemplated that the mooring system can use pre-installed segments, which include suction installed pile anchors or high performance drag embedment anchors. For 1760 feet of water, the anchor wire rope 48 is preferably 500 to 550 feet long with an outer diameter of about 4 and $\frac{7}{8}^{th}$ inches and a six-strand construction. Connected to the anchor wire rope 48 of this water depth embodiment is rope 56, which preferably is about 3100 feet long and has a 7½-inch OD, with a parallel strand construction. A second, a buoy, having 40-kip net buoyancy can be secured to the rope 56.

Rope 56 is connected at the end opposite the polymer rope to a second steel rope 60, known in the industry as a "vessel wire rope." For a 1760-foot water depth embodiment, this rope is approximately 3000 feet long having an outer diameter of 4 and ⅞ inches. The breaking strength of the rope is at least 2300 kips with a 1¹⁄₁₆ inch corrosion allowance. A preferred vessel wire rope 60, can be obtained from Diamond Blue. Vessel wire rope 60 is secured at the other end to tender 10. A high strength six-strand construction is preferred for the vessel wire rope 60.

It should be noted that even though polyester rope is the most preferred for polymer rope 52, other polymer ropes are contemplated as usable herein, including but not limited to polypropylene rope, polyethylene rope, polybutylene rope and combinations thereof. The construction of the polymer rope can range from parallel strand construction to wound multiple strand constructions as is generally know in the maritime industry. It should also be noted that at least 8 mooring lines are preferred but 7 lines with one broken can be used. In other embodiments, more mooring lines can be used. When 9 or more mooring lines are used instead of 8 mooring lines, the individual thickness of the mooring lines can be reduced while maintaining the required design safety factors for the tender.

Figure 3:
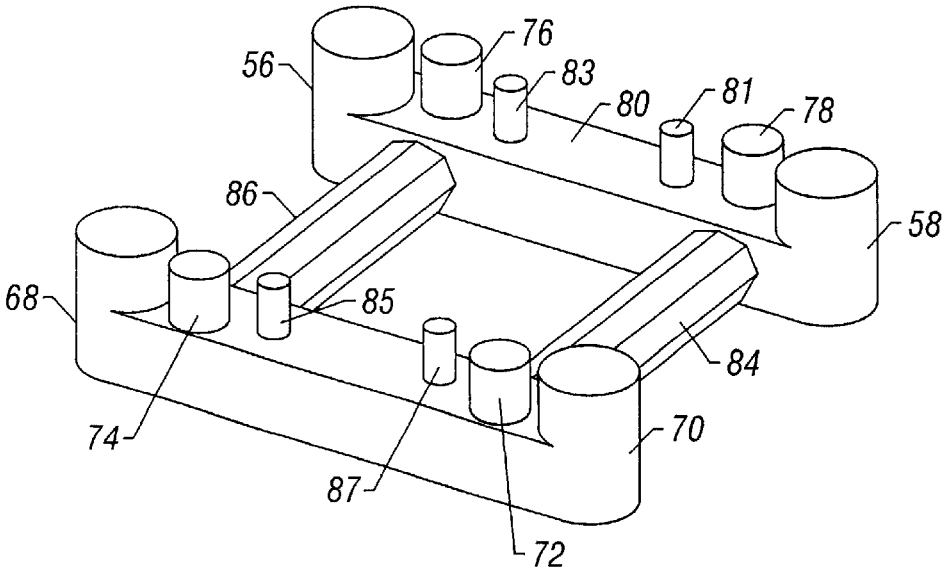
FIG. 3 is a perspective view of one embodiment of the tender of the invention.

FIG. 3 shows a view of the semisubmersible tender 10 having 8 supports 56, 58, 68, 70, 72, 74, 76, and 78. In the most preferred embodiment, the supports are structures with rounded edges or round shapes, such as columns. The deck is attached to these columns. In this Figure a rectangular shape is shown, but the tender is most preferably constructed in a ring design, with between 3 to 12 column supports. In FIG. 3, the 8 rounded supports are shown, as four large rounded supports as 56, 58, 68 and 70, and four smaller rounded supports are shown as 72, 74, 76 and 78. At least two pontoons 80 and 82 are shown in this embodiment. Each is capable of being ballasted. Preferably, each pontoon, if used, has rounded edges. In one embodiment, each pontoon is designed to have a stem and bow. Secured to the pontoons in one usable embodiment, are at least two buoyant transverse cross members 84 and 86, which are generally kept void but may be capable of being quickly ballasted. The pontoons are capable of transferring ballast quickly between pontoons and columns. The contemplated quick transverse ballast transfer is between about 30 and 300 gallons per minute, and preferably, 80 to 300 gallons per minute, and the quick longitudinal ballast transfer is between about 180 and 300 gallons per minute.

Figure 4:
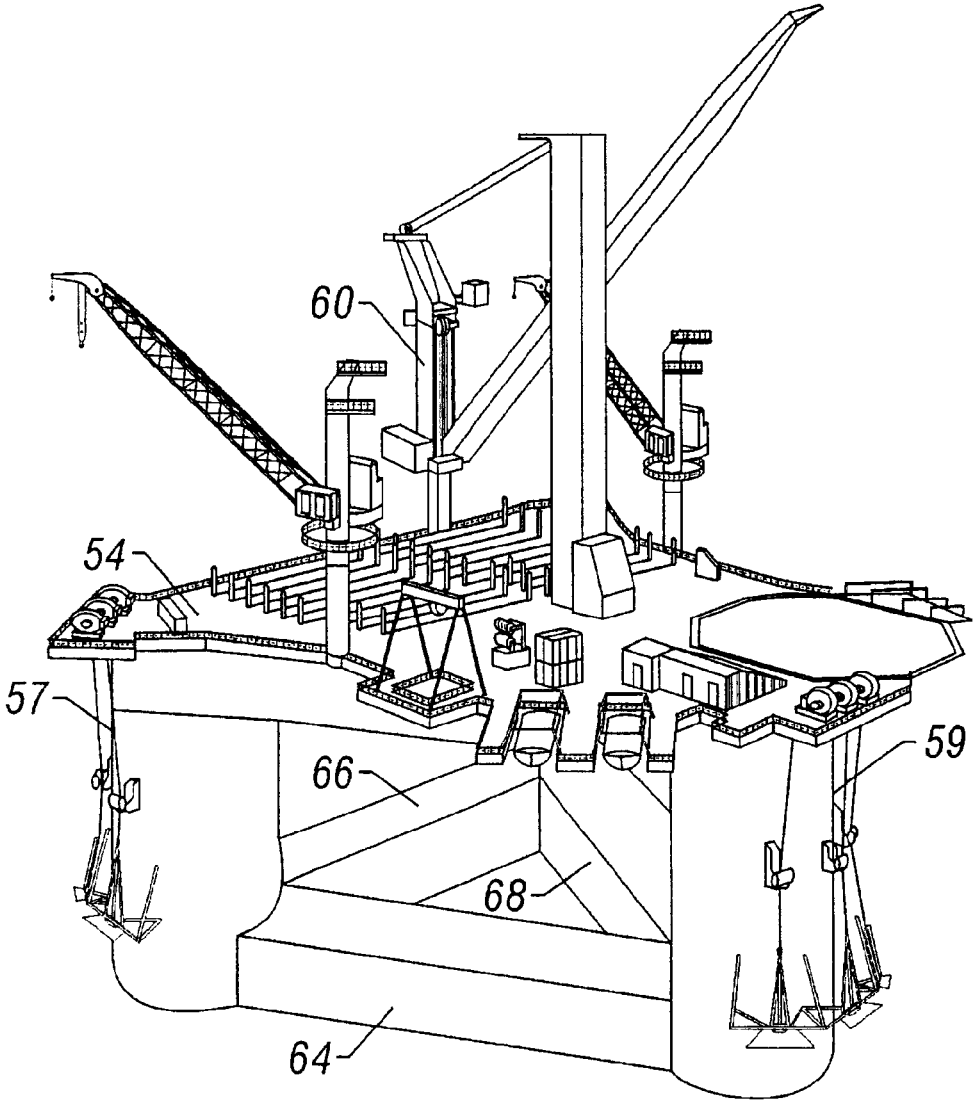
FIG. 4 is a perspective view of a ring design embodiment of the tender of the invention.

FIG. 4 shows an alternative construction of the tender using cross members 64, 66 and 68 engaging corresponding pontoons connected so as to form a triangular shape for the resultant tender. Crane 60 can be placed on the deck 54 which is supported by the columns disposed on the pontoons and supported by the cross members. It should be noted that it is within the scope of the invention that this tender be self propelled or towed on a body of water to a position near a production platform.

The semisubmersible tender of the invention preferably has at least 3 and up to 12 supports with a rounded shape. In the most preferred embodiment, the pontoons of the invention are assembled in a triangular ring design, though circular, square or rectangular shape will also work.

The tender is constructed to have a size and shape which results in a combined environmental load of less than 1,000 kips within a 100-year extreme weather condition, such as a hurricane when one of 8 mooring lines is damaged and when the tender is in the standby position. The tender shape results in a combined environmental load of less than 600 kips within a 10-year storm when secured to a production platform, like a SPAR, with one mooring line damaged, in a tendering position with 40 to 60 feet of consistent clearance between the tender and the production platform.

In a preferred embodiment, it is contemplated that the supports can contain traditional and non-traditional items. In one embodiment it is contemplated that when certain non-traditional items are used, they can be used to lower the center of gravity of the tender for additional stability. These items can include filled tanks of sterile brine completion fluids and ballast transfer equipment, bulk storage tanks, drilling and completion storage tanks, fluid tanks; ballast control systems; mooring line storage reels, transfer equipment for fluids in the designated tanks and combinations thereof. Specifically, the mooring storage line reels are used, they can be connected to winches within the supports, thereby lowering the center of gravity of the tender. The mooring winch storage can also be disposed in the supports to lower the center of gravity of the tender.

The tender and mooring system is capable of maintaining a safe clearance between the platform and the tender under the maximum operating conditions, specifically, up to the 10-year winter storm and up to the 10-year loop current condition in the Gulf of Mexico. For a SPAR, this is achieved by the use of dual mooring hawsers, which are tensioned to 100-kips to 150-kips each by adjusting the line tensions of the SPAR and the tender spread mooring legs while keeping the vessels at their designated locations. The designated location for the SPAR is directly above the subsea wellheads with the tender generally being kept between 50 ft and 80 ft from the SPAR.

Safe distance is maintained between the SPAR and the tender at all times, thus eliminating vessel collision risk. The use of tensioned hawsers assures synchronized mean and low frequency movement between the two vessels, should any mooring line break, the two floating vessels would move apart, thus increasing the distance between the two units.

When a major storm approaches the tender and mooring system, the hawsers will be slackened. The tender will be pulled away from the production platform to a safer distance, a tender standby position, due to the greater tension in the tender's bow mooring lines. If required, the tender can be winched further away from the production platform using its at least 8 point mooring system.

The tender will be further winched away from the SPAR to an extreme weather event standby position in the event of an imminent tropical storm or hurricane. The tender mooring is designed to withstand the 100-year hurricane and yet maintain a safe clearance with the production platform under a scenario where all mooring lines are intact or if one mooring line is damaged.

Figure 5:
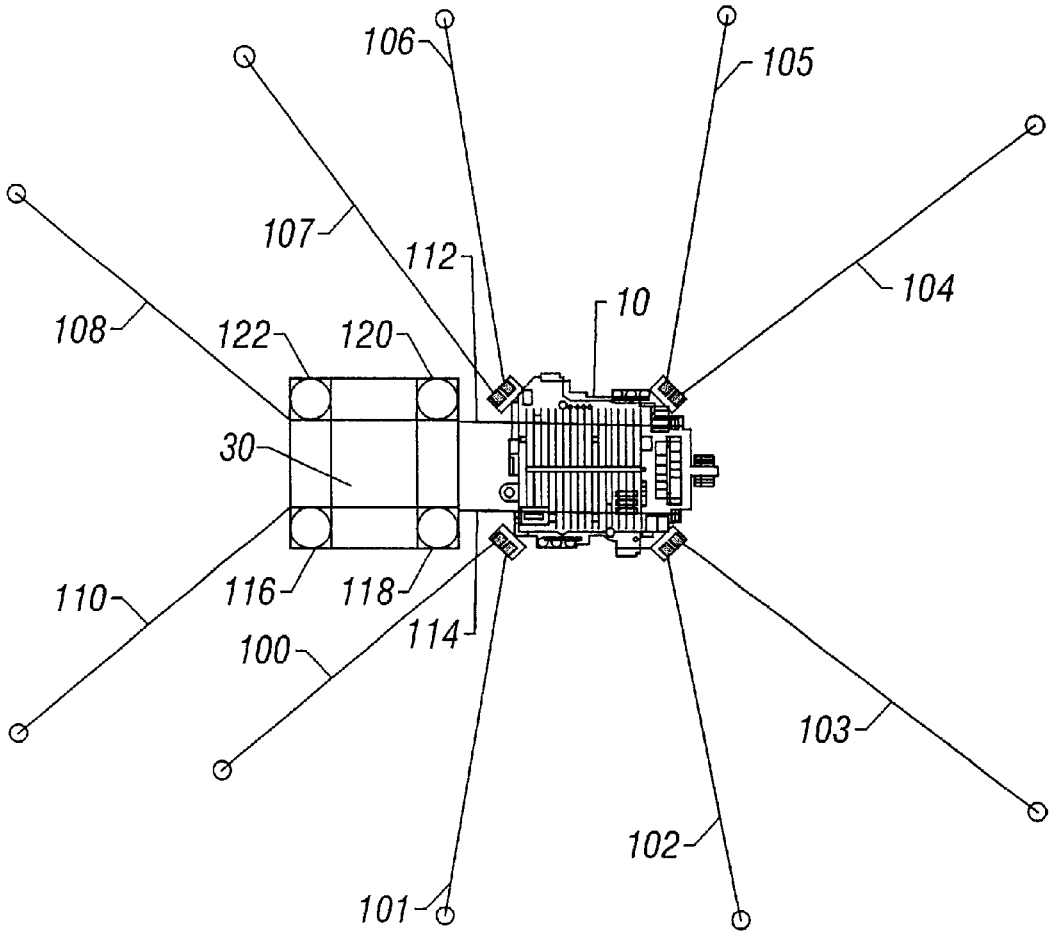
FIG. 5 is a top view of a moored tender to a tension leg platform.

FIG. 5 shows a preferred mooring line orientation for the semisubmersible tender when secured to a TLP. Mooring line 100 is oriented about 45 degrees from mooring line 102 when in the hurricane standby position. FIG. 5 shows the tender's mooring lines 100, 101, 102, 103, 104, 105, 106, and 107. In the preferred embodiment, all mooring lines are kept tensioned. The TLP's auxiliary mooring lines or tension lines are 108 and 110. These tension lines are used as a means to create global equilibrium between the TLP and the tender. The hawsers are 112 and do 114. Support columns for the TLP are 116, 118, 120, and 122.

For a TLP, the tender mooring system will consist of 8 spread-mooring legs and two mooring hawsers connecting the tender to the TLP. The TLP's position will be maintained by the use of two spread-mooring legs attached to the TLP on the opposite tender spread-mooring legs.

It should be noted that the tender has a lightship displacement of no more than 15,000 short tons and preferably is in the range of 8000 to 15,000 short tons, preferably 12,000 short tons.

The present invention additionally has zero discharge, which is a significant improvement over most current drilling and completion tenders, mobile offshore drilling units (MODU's) and API platform rigs in order to protect the environment.

Figure 6:
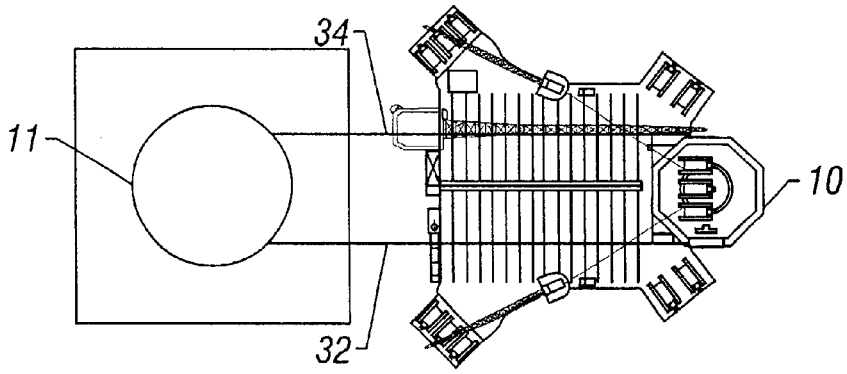
FIG. 6 is a top view of a tender secured to a SPAR with hawsers.

In FIG. 6, tender 10 is shown connects to the production platform 11 using at least two hawsers 32 and 34, with each hawser being constructed from a polyamide, such as a nylon.

The hawser line preferably has a diameter of 5.5 inches. The diameter of the hawser can range from 3 to 7 inches and the length can vary depending on the type of production platform the tenders are tied to as well as the anticipated severe weather conditions; each hawser having a length which is selected from the group: the length of the tender, the tendering distance, the length of the semisubmersible production vessel, and combinations thereof. The hawser is preferably rated for up to 1000 kips breaking strength.

Hawsers are connected to a connecting means such as hawser winches, which are capable of variable payout for connecting the tender to a production platform, such as a tension leg platform. Alternatively, the connecting means are a hawser wire rope that winds on a hawser winch. A preferred nylon hawser is from fibers made by the E. I. DuPont Company of Wilmington, Del. The hawser line should have adequate elasticity to accommodate the different wave frequency movement between tender and production platform, but are stiff enough so that tender and production platform mean and low frequency movements can be synchronized thereby enabling the tender to move in substantially identical mooring watch pattern shapes, such as a figure eight mooring watch pattern or an elliptically shaped mooring watch pattern.

In a preferred embodiment, hawsers have adequate elasticity to accommodate the wave frequency movements between the production platform and the tender, and adequate stiffness to synchronize the mean and low frequency movement between the production platform and the tender under an environmental load produced during a storm having a designation of up to a 10-year storm in the tendering position, and wherein said hawsers remain slack during a storm designated as at least a 10-year storm for the tender in the tender standby position. The tender can synchronize between the mean and low frequency excursions, which have greater than 50 second periods, by tensioning the hawsers. The inventive system allows the tender to accommodate the relative wave frequency motions which can range from 3 to 25 seconds in full cycle period by optimizing the elasticity of the mooring lines. The invention enables a safe clearance, of at least 35 feet to be maintained between the production platform and the tender during all possible tendering conditions, whether or not one mooring line is damaged or all lines are intact.

A usable safe operating distance is considered between 35 and 80 feet, and preferably at least 40 and more typically, 50 to 60 feet of safe clearance in normal weather and current which can be a sudden squall, a 1-year winter storm and a 1-year loop current.

The unique tender preferably has a size with at least 15,000 square feet and up to about 40,000 square feet of deck space most preferably, 25,000 square feet.

The tender has three positions relative to the production platform: (i) extreme weather standby (for cyclone storms); (ii) tender standby for weather conditions of 10-year storms, or greater; and (iii) operating tender for weather conditions up to a 10-year storm. It is possible there may be a benign weather condition position as well, which could be closer than 35 feet.

When in the extreme weather standby mode, the hawsers are slacked, then the hawsers are then released and the tender is winched away to a safe distance so that no collision occurs between the production platform and the tender. This extreme weather standby mode is used in not only the 100-year winter storm, but in a 100-year hurricane or when a 100-year loop current causes severe current, wave, and related weather conditions. The safe clearance distance maintained by the tender in the extreme weather tender standby mode is preferably at least 200 feet for the 100-year winter storm, and at least 500 feet for the 100-year hurricane and up to 1000 feet when moored in extremely deep water.

For the tender standby mode, such as in weather which is greater than a 10-year storm, the tender is still connected to the platform with the hawsers slack, but the tender is maintained at a distance of between about 150 and 350 feet.

In the operating tender mode, the clearance between the tender and the platform is a relatively constant 50 to 60 feet.

It should be noted that it is preferred that, the mooring lines conform to API standard RP-2SK.

The tender supports can have a variety of uses, for example, as bulk storage tanks, which can contain barite, cement, or bentonite. Another use for the columns is to contain sterile completion fluids or base drilling and completion fluids. The tanks can hold completion fluids such as calcium chloride, zinc bromide or potassium chloride.

Figure 7A:
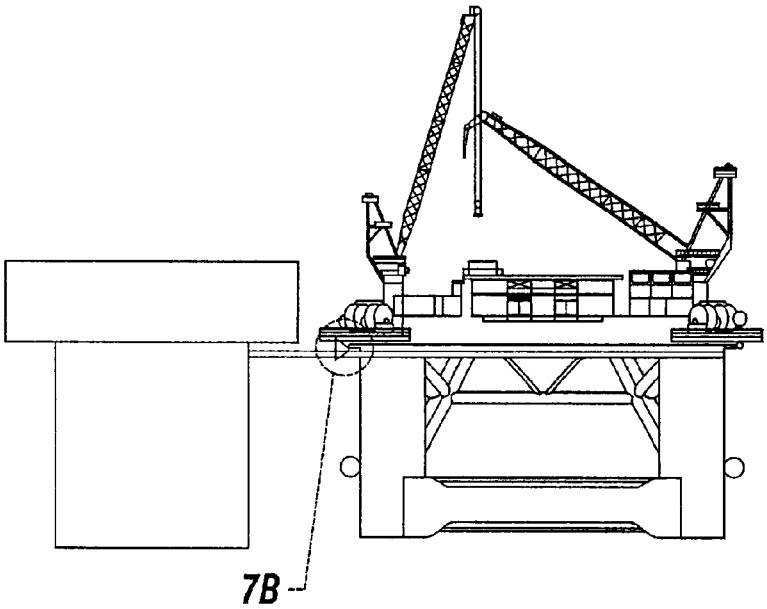
FIG. 7 shows a top view of a first embodiment of hawser guides.
Figure 7B:
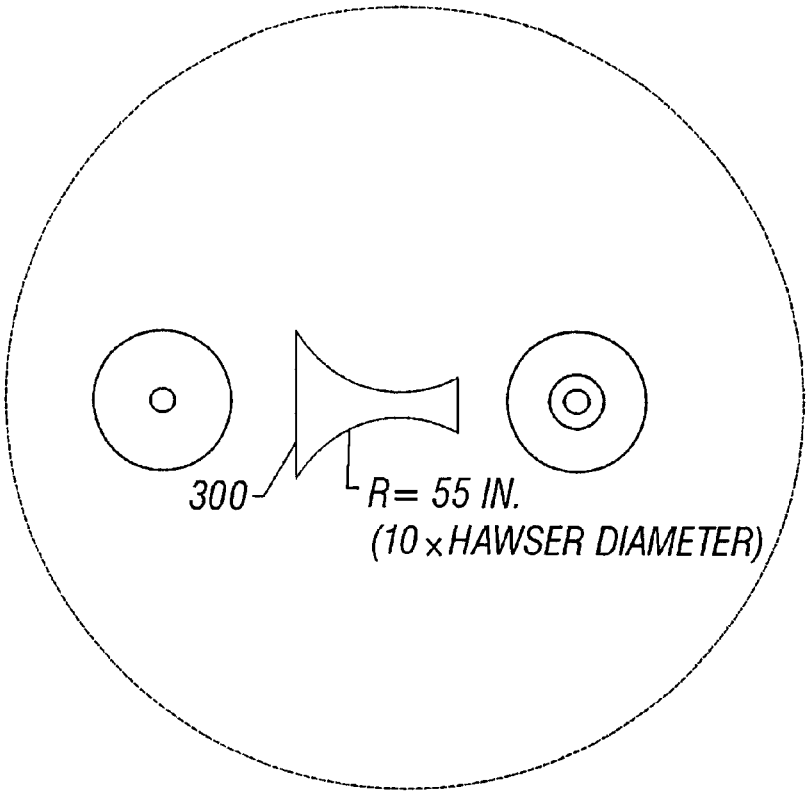

FIG. 7 shows as horn 300 is construction to reduce friction on the hawsers 32 or 34, enabling successful slackening of the hawsers or tensioning of the hawsers with minimal friction impact on the lines. These conical horns are of a bullhorn style, with the largest portion of the horn facing the stem of the tender, and the narrow portion facing the bow. The radius of curvature of the horn should be at least eight times the diameter of the hawser to ensure the hawser is not damaged during use, preferably 10 times the hawsers diameter. The horns are preferably of steel with a treated interior surface to minimize the coefficient of friction between the guide itself and the hawsers to minimize the frictional wear or damage of the hawser. Hawser 32 passes through the center of the horn 300.

The tender has additional hawser guidance elements for the hawser lines. Rounded pad eyes are secured to the underside of the tender hull and the hawsers pass through the pad eyes to a wire, which is connected to a winch on the bow of the tender. The purpose of these pad eyes is to support the hawser when slack, preventing the hawsers from being damaged. The purpose of the wire and wire winch is to eliminate the need for the hawser to be wound on a winch driver, passing through sheaves, which would damage the hawser. When the tender moves to the tender standby position, the wire is simply paid off of the wire hawser winches. The other end of hawser is connected to the production platform using a pad eye or some other similar kind of attached device.

The mooring and tender system further contemplates having on the tender or otherwise using a measurement system to record exact distance and spacial relationship between the tender and the production platform. It also contemplates using a camera system, which allows the tender, production platform, hawsers, hawser guidance system and related equipment to be monitored. Finally, the tender may have installed on it, or the system may include, a monitoring system to analyze any variations in tension on the connecting means of the tender.

The hawser winches for the tender are preferably ones with drums having a capacity of at least 600 feet of 3-inch wire rope. The winches preferably have a pull rating of 100,000 lbs @ 28 fpm. The drums preferably have brakes, which are spring set and air release band types rated at 600,000 lbs. The winch power is preferably 100 hp using an AC motor with disk brakes and variable frequency drive. The drum preferably has a 45-inch root diameter with 60-inch long size for single layer operation. In the preferred embodiment, the winch rope is connected to the hawser, then the desired pre-tension is exerted by the winch motor. At this point the winch drum brakes is set. If the hawser line pull exceeds the brake rating (600,000 lbs), rope will pull off the drum until equilibrium is re-established. Any readjustment to the length/tension will be accomplished manually.

More specifically, the invention relates to a semisubmersible tender with a lightship displacement less than 15,000 short tons for a deep draft cassion vessel (SPAR) used as a production platform having a mooring system.

The vessel can be connected to a wide varsity of production platforms. If connected to a deep draft cassion vessel, such as a SPAR, it comprises:

a. a deck;

b. a shape that results in a combined environmental load of less than 1000 kips within a 100-year extreme weather condition;

c. a plurality of supports, each with a rounded shape, connected to said deck;

d. a plurality of pontoons connected to said supports, each pontoon being capable of ballast transfer;

e. at least two hawsers for connecting said tender to said SPAR, each hawser having a length which is selected from the group: the length of the tender, the tendering distance, the length of the SPAR, and combinations thereof; and wherein said hawsers have adequate elasticity to accommodate the wave frequency between the SPAR and the tender, and adequate stiffness to synchronize the mean and low frequency movements between the SPAR and the tender under an environmental load produced during a storm having a designation of up to a 10-year winter storm in the tendering position, and wherein said hawsers remain slack during a storm designed as at least a 10 year storm for the tender in the tender standby position;

f. connecting means mounted on the tender securing a first end of each hawser;

g. a hawser guidance system for each hawser to direct each said hawser to the SPAR;

h. an at least 8 point mooring system for said tender; and i. means for creating global equilibrium between the SPAR's mooring system and said at least 8 point mooring system of said tender.

The vessel is moored to the sea floor using an 8-point mooring system. This mooring system preferably has: (a) at least 8 anchors; and (b) at least 8 mooring lines, each line consisting of: a first length of steel wire rope secured to each of said anchors; a length of polymer rope secured to each of said first length of steel wire rope; a second length of steel wire rope having a first and second end, and wherein said first end is secured to said length of polymer rope and said second end is secured to the tender; and wherein said mooring line has adequate elasticity, stiffness and strength to accommodate the load on said tender under an environmental load produced by an up to a 10-year storm in the tendering position, and further wherein said mooring lines have a strength to withstand the environmental load produced by up to a 100-year extreme weather condition when said tender is moved to a 100-year extreme weather condition standby position.

For the TLP embodiment, the tender further comprises:

a. a deck;

b. a shape that results in a combined environmental load of less than 1000 kips within a 100-year extreme weather condition comprising:

i. a plurality of supports each with a rounded shape connected to said deck;

ii. a plurality of pontoons connecting said supports, each pontoon being capable of ballast transfer;

iii. at least two hawsers for connecting said tender to said TLP, each hawser having a length which is selected from the group: the length of the tender, the tendering distance, the length of the tension leg production platform, and combinations thereof, and wherein the hawsers have adequate elasticity to accommodate the wave frequency between the TLP and the tender, and adequate stiffness to synchronize the mean and low frequency movements between the TLP and the tender under an environmental load produced during a storm having a designation of up to a 10-year winter storm in the tendering position, and wherein said hawsers remain slack during a storm designated as at least a 10-year storm or greater for the tender in the tender standby position;

iv. connecting means mounted on the tender and securing a first end of each hawser;

v. a hawser guidance system for each hawser to direct each said hawser to the TLP;

vi. an at least 8 point mooring system for said tender; and vii. means for creating global equilibrium between the TLP's tethers, tensioning line and mooring system, and said at least 8 point mooring system of said tender.

If a compliant tower production platform is used, the tender comprises:

a. a deck;

b. a shape that results in a combined environmental load of less than 1000 kips within a 100-year extreme weather condition;

c. a plurality of supports each with a rounded shape connected to said deck;

d. a plurality of pontoons connecting said supports, each pontoon being capable of ballast transfer;

e. at least two hawsers for connecting said tender to said compliant tower production platform, each hawser having a length which is selected from the group: the length of the tender, the tendering distance, the length of the compliant tower production platform, and combinations thereof; and wherein the hawsers have adequate elasticity to accommodate the wave frequency between the compliant tower and the tender, and adequate stiffiess to synchronize the mean and low frequency movement between the compliant tower and the tender under an environmental load produced during a storm having a designation of up to a 10-year winter storm in the tendering position, and wherein said hawsers remain slack during a storm designated as at least a 10-year storm for the tender in the tender standby position;

f. connecting means mounted on the tender and securing a first end of each hawser;

g. a hawser guidance system for each hawser to direct each said hawser to the compliant tower;

h. an at least 8 point mooring system for said tender; and i. means for creating global equilibrium between the compliant tower and said at least 8 point mooring system of said tender.

Again, the tender can be moored in the same manner it was moored for the SPAR and the TLP.

The tender can be used for a fixed leg production platform and can comprise:

a. a deck;

b. a shape that results in a combined environmental load of less than 1000 kips in a 100-year extreme weather condition;

c. a plurality of supports each with a rounded shape connected to said deck;

d. a plurality of pontoons connecting said supports, each pontoon being capable of ballast transfer, e. at least two hawsers for connecting said tender to said fixed leg production platform, each hawser having a length which is selected from the group: the length of the tender, the tendering distance, the length of the fixed leg production platform, and combinations thereof, and wherein said hawsers have adequate elasticity to accommodate the wave frequency between the fixed leg production platform and the tender, and adequate stiffness and tension to synchronize the mean and low frequency movement between the fixed leg production platform and the tender under an environmental load produced during a storm having a designation of up to a 10-year winter storm in the tendering position, and wherein said hawsers remain slack during a storm designated as at least a 10 year storm for the tender in the tender standby position;

f. connecting means mounted on the tender and securing a first end of each hawser;

g. a hawser guidance system for each hawser to direct each said hawser to the fixed leg production platform; and h. an at least 8 point tender mooring system for said tender; and i. means for creating global equilibrium between the fixed leg production platform and said at least 8 point mooring system of said tender.

The tender can be used for a tendering to another semisubmersible production platform. In that embodiment, the tender can comprise:

a. a deck, b. a shape that results in a combined environmental load less than 1000 kips in a 100-year extreme weather condition;

c. a plurality of supports each with a rounded shape, connected to said deck;

d. a plurality of pontoons connecting said supports, each pontoon being capable of ballast transfer;

e. at least two hawsers for connecting said tender to said semisubmersible production vessel, each hawser having a length which is selected from the group: the length of the tender, the tendering distance, the length of the semisubmersible production vessel, and combinations thereof; and wherein the hawsers have adequate elasticity to accommodate the wave frequency between the semisubmersible production vessel and the tender, and adequate stiffness to synchronize the mean and low frequency movement between the semisubmersible production vessel and the tender under an environmental load produced during a storm having a designation of up to a 10-year winter storm in the tendering position, and wherein said hawsers remain slack during a storm designated as at least a 10-year storm for the tender in the tender standby position;

f. connecting means mounted on the tender and securing a first end of each hawser;

g. a hawser guidance system for each hawser to direct each said hawser to the semisubmersible production vessel;

h. an at least 8 point tender mooring system for said tender; and i. means for creating global equilibrium between the semisubmersible production vessel's mooring system and said at least 8 point mooring system of said tender.

The additional tensioning lines or tethers are an important feature of the invention for tensioning and release of tension to the hawsers.

It should be noted, that the invention contemplates that the tender system would work with jack-ups and other types of rigs besides those mentioned.

Variations can occur within the scope of this invention. For example, it is contemplated that this 8-point mooring system for the tender to a SPAR could be a damaged 8-point system, that is, a 7-line system with one broken line and still work within the scope of the invention.

Turning to the construction of the tender the tender for each platform, pontoons connecting the supports. These pontoons can be connected to form a rectangular shape or a triangular shape. Regardless of how the pontoons are connected, it is contemplated that the ballast in the pontoons can move at a transverse ballast rate of between 30 and 300 gallons per minute. It is also contemplated that the ballast can be moved at a longitudinal ballast transfer at a rate in a range of from 180 to 300 gallons per minute.

Further features and advantages of the invention will be apparent from the specification and the drawing.

What is claimed is:

1. A semisubmersible tender with a lightship displacement less than 15,000 short tons for a deep draft cassion vessel (SPAR) used as a production platform having a mooring system, comprising:

a. a deck;

b. a shape that results in a combined environmental load of less than 1000 kips within a 100-year extreme weather condition;

c. a plurality of supports, each with a rounded shape, connected to said deck;

d. a plurality of pontoons connected to said supports, each pontoon being capable of ballast transfer;

e. at least two hawsers for connecting said tender to said SPAR, each hawser having a length which is selected from the group: the length of the tender, the tendering distance, the length of the SPAR, and combinations thereof; and wherein said hawsers have adequate elasticity to accommodate the wave frequency between the SPAR and the tender, and adequate stiffness to synchronize the mean and low frequency movements between the SPAR and the tender under an environmental load produced during a storm having a designation of up to a 10-year winter storm in the tendering position, and wherein said hawsers remain slack during a storm designed as at least a 10 year storm for the tender in the tender standby position;

f. connecting means mounted on the tender securing a first end of each hawser;

g. a hawser guidance system for each hawser to direct each said hawser to the SPAR;

h. an at least 8 point mooring system for said tender; and i. means for creating global equilibrium between the SPAR's mooring system and said at least 8 point mooring system of said tender.

2. The tender of claim 1, wherein said at least 8-point mooring system further comprises:

a. at least 8 anchors;

b. at least 8 mooring lines, each line consisting of: a first length of steel wire rope secured to each of said anchors; a length of polymer rope secured to each of said first length of steel wire rope; a second length of steel wire rope having a first and second end, and wherein said first end is secured to said length of polymer rope and said second end is secured to the tender; and wherein said mooring line has adequate elasticity, stiffness and strength to accommodate the load on said tender under an environmental load produced by an up to a 10-year storm in the tendering position, and further wherein said mooring lines have a strength to withstand the environmental load produced by up to a 100-year extreme weather condition when said tender is moved to a 100-year extreme weather condition standby position.

3. The tender of claim 1, wherein the connecting means are hawser winches.

4. The tender of claim 1, wherein the connecting means comprise a hawser wire rope, which winds on a hawser winch.

5. The tender of claim 2, wherein said mooring lines are taunt.

6. The tender of claim 1, wherein said supports are rounded columns connected in a ring pontoon design.

7. A semisubmersible tender with a lightship displacement of less than 15,000 short tons for a tension leg production platform (TLP) having at least one tether, and a mooring system, comprising:

a. a deck;

b. a shape that results in a combined environmental load of less than 1000 kips within a 100-year extreme weather condition comprising:

c. a plurality of supports each with a rounded shape connected to said deck;

d. a plurality of pontoons connecting said supports, each pontoon being capable of ballast transfer;

e. at least two hawsers for connecting said tender to said TLP, each hawser having a length which is selected from the group: the length of the tender, the tendering distance, the length of the tension leg production platform, and combinations thereof; and wherein the hawsers have adequate elasticity to accommodate the wave frequency between the TLP and the tender, and adequate stiffness to synchronize the mean and low frequency movements between the TLP and the tender under an environmental load produced during a storm having a designation of up to a 10-year winter storm in the tendering position, and wherein said hawsers remain slack during a storm designated as at least a 10-year storm or greater for the tender in the tender standby position;

f. connecting means mounted on the tender and securing a first end of each hawser;

g. a hawser guidance system for each hawser to direct each said hawser to the TLP;

h. at least one tensioning line for providing tension to said hawsers from said production platform, and wherein said at least one tensioning line is secured to said TLP on the side opposite the tender;

i. an at least 8 point mooring system for said tender; and j. means for creating global equilibrium between the TLP's tethers, tensioning line and mooring system, and said at least 8 point mooring system of said tender.

8. The tender of claim 7, wherein said at least 8-point mooring system further comprises:

a. at least 8 anchors;

b. at least 8 mooring lines, each line consisting of: a first length of steel wire rope secured to each of said anchors; a length of polymer rope secured to each of said first length of steel wire rope; a second length of steel wire rope having a first and second end, and wherein said first end is secured to said length of polymer rope and said second end is secured to the tender; and wherein each said mooring line has adequate elasticity, stiffness and strength to accommodate load on said tender under an environmental load produced by an up to a 10-year storm in the tendering position, and further wherein said mooring lines have a strength to withstand the environmental load produced by and up to 100-year extreme weather condition when said tender is moved to a 100-year extreme weather condition standby position.

9. The tender of claim 7, wherein the connecting means are hawser winches.

10. The tender of claim 7, wherein the connecting means comprise a hawser wire rope, which winds on a hawser winch.

11. The tender of claim 7, wherein said mooring lines are taunt.

12. The tender of claim 7, wherein said supports are rounded columns connected in a ring pontoon design.

13. A semisubmersible tender with a lightship displacement less than 15,000 short tons for a compliant tower production platform having a steel structure extending to the sea floor, comprising:

a. a deck;

b. a shape that results in a combined environmental load of less than 1000 kips within a 100-year extreme weather condition;

c. a plurality of supports each with a rounded shape connected to said deck;

d. a plurality of pontoons connecting said supports, each pontoon being capable of ballast transfer;

e. at least two hawsers for connecting said tender to said compliant tower production platform, each hawser having a length which is selected from the group: the length of the tender, the tendering distance, the length of the compliant tower production platform, and combinations thereof; and wherein the hawsers have adequate elasticity to accommodate the wave frequency between the compliant tower and the tender, and adequate stiffness to synchronize the mean and low frequency movement between the compliant tower and the tender under an environmental load produced during a storm having a designation of up to a 10-year winter storm in the tendering position, and wherein said hawsers remain slack during a storm designated as at least a 10-year storm for the tender in the tender standby position;

f. connecting means mounted on the tender and securing a first end of each hawser;

g. a hawser guidance system for each hawser to direct each said hawser to the compliant tower;

h. at least one tensioning line for providing tension from said production platform to said hawsers;

i. an at least 8 point mooring system for said tender; and j. means for creating global equilibrium between the compliant tower and said at least 8 point mooring system of said tender.

14. The tender of claim 13, wherein at least 8-point mooring system tender further comprises:

a. at least 8 anchors;

b. at least 8 mooring lines, each consisting of: a first length of steel wire rope secured to each of said anchors; a length of polymer rope secured to each of said first length of steel wire rope; a second length of steel wire rope having a first and second end, and wherein said first end is secured to said length of polymer rope and said second end is secured to the tender; and wherein said mooring line has adequate elasticity, stiffness and strength to accommodate the load on said tender under an environmental load produced by up to a 10-year storm in the tendering position, and further wherein said mooring lines have a strength to withstand the environmental load produced by a 100-year extreme weather condition when said tender is moved to a 100-year extreme weather condition standby position.

15. The tender of claim 13, wherein said compliant tower further comprises at least one tensioning line.

16. The tender of claim 13, wherein the connecting means are hawser winches.

17. The tender of claim 13, wherein the connecting means comprise a hawser wire rope, which winds on a hawser winch.

18. The tender of claim 13, wherein said mooring lines are taunt.

19. The tender of claim 13, wherein said supports are rounded columns.

20. A semisubmersible tender with a lightship displacement of less than 15,000 short tons for a fixed leg production platform, comprising:

a. a deck;

b. a shape that results in a combined environmental load of less than 1000 kips in a 100-year extreme weather condition;

c. a plurality of supports each with a rounded shape connected to said deck;

d. a plurality of pontoons connecting said supports, each pontoon being capable of ballast transfer, e. at least two hawsers for connecting said tender to said fixed leg production platform, each hawser having a length which is selected from the group: the length of the tender, the tendering distance, the length of the fixed leg production platform, and combinations thereof; and wherein said hawsers have adequate elasticity to accommodate the wave frequency between the fixed leg production platform and the tender, and adequate stiffness to synchronize the mean and low frequency movement between the fixed leg production platform and the tender under an environmental load produced during a storm having a designation of up to a 10-year winter storm in the tendering position, and wherein said hawsers remain slack during a storm designated as at least a 10 year storm for the tender in the tender standby position;

f. connecting means mounted on the tender and securing a first end of each hawser;

g. a hawser guidance system for each hawser to direct each said hawser to the fixed leg production platform; and h. an at least 8 point tender mooring system for said tender; and i. means for creating global equilibrium between the fixed leg production platform and said at least 8 point mooring system of said tender.

21. The tender of claim 20, wherein said tender further comprises:

a. at least 8 anchors;

b. at least 8 mooring lines, each consisting of: a first length of steel wire rope secured to each of said anchors; a length of polymer rope secured to each of said first length of steel wire rope; a second length of steel wire rope having a first and second end, and wherein said first end is secured to said length of polymer rope and said second end is secured to the tender; and wherein said mooring line has adequate elasticity, stiffness and strength to accommodate the load on said tender under an environmental load produced by an up to 10-year storm in the tendering position, and further wherein said mooring lines have a strength to withstand the environmental load produced by up to a 100-year extreme weather condition, when said tender is moved to a 100-year extreme weather standby position.

22. The tender of claim 20, wherein the connecting means are hawser winches.

23. The tender of claim 20, wherein the connecting means comprise a hawser wire rope, which winds on a hawser winch.

24. The tender of claim 20, wherein said mooring lines are taunt.

25. The tender of claim 20, wherein said pontoons of said tender are connected in a ring design.

26. A semisubmersible tender with a lightship displacement of less than 15,000 short tons for a semisubmersible production vessel with a mooring system, comprising:

a. a deck, b. a shape that results in a combined environmental load less than 1000 kips in a 100-year extreme weather condition;

c. a plurality of supports each with a rounded shape, connected to said deck;

d. a plurality of pontoons connecting said supports, each pontoon being capable of ballast transfer;

e. at least two hawsers for connecting said tender to said semisubmersible production vessel, each hawser having a length which is selected from the group:

the length of the tender, the tendering distance, the length of the semisubmersible production vessel, and combinations thereof; and wherein the hawsers have adequate elasticity to accommodate the wave frequency between the semisubmersible production vessel and the tender, and adequate stiffness to synchronize the mean and low frequency movement between the semisubmersible production vessel and the tender under an environmental load produced during a storm having a designation of up to a 10-year winter storm in the tendering position, and wherein said hawsers remain slack during a storm designated as at least a 10-year storm for the tender in the tender standby position;

f. connecting means mounted on the tender and securing a first end of each hawser;

g. a hawser guidance system for each hawser to direct each said hawser to the semisubmersible production vessel;

h. an at least 8 point tender mooring system for said tender; and i. means for creating global equilibrium between the semisubmersible production vessel's mooring system and said at least 8 point mooring system of said tender.

27. The tender of claim 26, wherein said at least 8-point mooring system further comprises:

a. at least 8 anchors;

b. at least 8 mooring lines, each line consisting of: a first length of steel wire rope secured to each of said anchors; a length of polymer rope secured to each of said first length of steel wire rope; a second length of steel wire rope having a first and second end, and wherein said first end is secured to said length of polymer rope and said second end is secured to the tender; and wherein said mooring line has adequate elasticity, stiffness and strength to accommodate load on said tender under an environmental load produced by an up to a 10-year storm in the tendering position, and further wherein said mooring lines have a strength to withstand the environmental load produced by up to a 100-year extreme weather condition, when said tender is moved to a 100-year extreme weather condition standby position.

28. The tender of claim 26, wherein the connecting means are hawser winches.

29. The tender of claim 26, wherein the connecting means comprise a hawser wire rope, which winds on a hawser winch.

30. The tender of claim 26, wherein said mooring lines are taunt.

31. The tender of claim 26, wherein said pontoons are connected in a ring design.

32. A mooring and tender system for securing a tender to a production platform, comprising:

a. a semisubmersible tender for a production platform having mooring means and having a lightship displacement of less than 15,000 short tons, comprising:

i. a deck;

ii. a shape that results in a combined environmental load of less than 1000 kips in a 100-year extreme weather condition;

iii. a plurality of supports with a rounded shape connected to said deck;

iv. a plurality of pontoons connecting said supports, each pontoon being capable of transverse ballast transfer and longitudinal ballast transfer;

v. at least two hawsers for connecting said tender to said production platform, each hawser having a length which is selected from the group: the length of the tender, the tendering distance, the length of the production platform, and combinations thereof; and wherein said hawsers have adequate elasticity to accommodate the wave frequency between the production platform and the tender, and adequate stiffness to synchronize the mean and low frequency movement between the production platform and the tender under an environmental load produced during a storm having a designation of up to a 10-year storm in the tendering position, and wherein said hawsers remain slack during a storm designated as at least a 10-year storm for the tender in the tender standby position;

vi. connecting means mounted on the tender and securing a first end of each hawser;

vii. a hawser guidance system for each hawser to direct each said hawser to the production platform;

viii. an at least 8-point mooring system for said tender comprising:

(a) at least 8 anchors;

(b) at least 8 mooring lines, each line consisting of: a first length of steel wire rope secured to each of said anchors; a length of rope secured to each of said first length of steel wire rope; a second length of steel wire rope having a first and second end, and wherein said first end is secured to said length of rope and said second end is secured to the tender; and wherein each said mooring line has adequate elasticity, stiffness and strength to accommodate load on said tender under an environmental load produced by an up to a 10-year storm in the tendering position, and further wherein said mooring lines have a strength to withstand the environmental load produced by up to a 100-year extreme weather condition when said tender is moved to a 100-year extreme weather condition standby position; and (c) means for creating global equilibrium between the production platform's mooring means and said at least 8 point mooring system of said tender.

33. The mooring and tender system of claim 32, wherein said tender pontoons are constructed in the shape of a ring and said shape is selected from the group: triangular, rectangular, square, and triangular.

34. The mooring and tender system of claim 32, wherein the at least 8 point mooring system comprises a 7 line mooring system, and one broken mooring line.

35. The mooring and tender system of claim 32, wherein the transverse ballast transfer occurs at a rate in a range from at least 30 to 300 gallons per minute.

36. The mooring and tender system of claim 32, wherein the longitudinal ballast transfer occurs at a rate in a range of from 180 to 300 gallons per minute.

37. The mooring and tender system of claim 32, wherein said pontoons are ballasted.

38. The mooring and tender system of claim 32, wherein said pontoons have rounded edges.

39. The mooring and tender system of claim 32, wherein said supports are round columns.

40. The mooring and tender system of claim 39, wherein shape comprises between 3 and 12 columns.

41. The mooring and tender system of claim 32, wherein said supports contain a member of the group comprising: ballast transfer equipment, bulk storage tanks; drilling mud storage tanks; fluid tanks; ballast control systems; mooring line storage reels, transfer equipment for fluids in the designated tanks and combinations thereof.

42. The mooring and tender system of claim 41, wherein said mooring line storage reels are connected to winches disposed within said supports, thereby lowering the center of gravity of said tender.

43. The mooring and tender system of claim 32, wherein said length of rope has an outer diameter between 4 and 10 inches.

44. The mooring and tender system of claim 32, wherein said length of rope is a material selected from the group: polyester, polypropylene, polyethylene, and combinations thereof.

45. The mooring and tender system of claim 32, wherein said hawsers are made from a polyamide.

46. The mooring and tender system of claim 44, wherein said polyamide is nylon.

47. The mooring and tender system of claim 32, wherein said production platform is of a member of the group: a deep draft cassion vessel (SPAR), a tension leg platform (TLP), a semisubmersible production vessel, a fixed leg production platform and a compliant tower production platform.

48. The mooring and tender system of claim 32, further comprising a measurement system to record the exact distance and spacial relationship between said tender and said production platform.

49. The mooring and tender system of claim 32, further comprising a camera system which allows the tender, production platform, hawsers, hawser guidance system, and related equipment to be monitored.

50. The mooring and tender system of claim 32, further comprising a monitoring system to analyze any variation in tension on the connecting means.

51. The mooring and tendering system of claim 41, further comprising mooring winch storage disposed in said supports to lower the center of gravity of said tender.

52. The mooring and tendering system of claim 42, wherein said fluid tanks contain sterile brine completion fluids.

53. The mooring and tendering system of claim 49, wherein said hawser guidance system comprises a conical horn through which the hawser line is passed.

* * * * *